US006520227B2

(12) United States Patent
Mc Farlin, Jr. et al.

(10) Patent No.: US 6,520,227 B2
(45) Date of Patent: Feb. 18, 2003

(54) APPARATUS AND METHOD FOR MOUNTING ROUTERS IN TABLES

(76) Inventors: Robert E. Mc Farlin, Jr., 2622 E. 30th St., Des Moines, IA (US) 50317; David L. Henderson, 3641 NE. 56th Pl., Berwick, IA (US) 50031

( * ) Notice: Subject to any disclaimer, the term of this patent is extended or adjusted under 35 U.S.C. 154(b) by 0 days.

(21) Appl. No.: 09/925,164

(22) Filed: Aug. 8, 2001

(65) Prior Publication Data

US 2002/0020466 A1 Feb. 21, 2002

Related U.S. Application Data

(60) Provisional application No. 60/224,190, filed on Aug. 9, 2000.

(51) Int. Cl.[7] ..... B27M 1/00; B25H 1/00; B27C 5/00

(52) U.S. Cl. ..... 144/371; 144/135.2; 144/137; 144/286.1; 144/286.5; 144/329; 409/226

(58) Field of Search ..... 144/2.1, 134.1, 144/135.2, 136.95, 137, 154.5, 329, 371, 286.1, 286.5; 409/182, 159, 163, 226

(56) References Cited

U.S. PATENT DOCUMENTS

| | | | | |
|---|---|---|---|---|
| 1,565,790 A | | 3/1925 | Carter | |
| 1,611,381 A | | 6/1926 | Salsbury | |
| 1,820,162 A | | 8/1931 | Salvat | |
| 1,882,586 A | | 10/1932 | Haynes | |
| 1,960,699 A | | 5/1934 | Galloway | |
| 2,625,844 A | | 1/1953 | Beckett et al. | |
| 4,239,428 A | | 12/1980 | Berzina | |
| 4,410,022 A | | 10/1983 | Peterson | |
| 4,440,050 A | | 4/1984 | Kagerer | |
| 4,770,573 A | | 9/1988 | Monobe | |
| 5,025,841 A | * | 6/1991 | Totten | 144/135.2 |
| 5,056,375 A | | 10/1991 | Kapton et al. | |
| 5,139,061 A | | 8/1992 | Neilson | |
| 5,191,921 A | | 3/1993 | Mc Curry | |
| 5,289,861 A | * | 3/1994 | Hedrick | 144/135.2 |
| 5,398,740 A | * | 3/1995 | Miller | 144/135.2 |
| 5,556,243 A | * | 9/1996 | Bory | 144/135.2 |
| 5,590,989 A | | 1/1997 | Mulvihill | |
| 5,699,844 A | * | 12/1997 | Witt | 144/135.2 |
| 5,725,036 A | | 3/1998 | Walter | |
| 5,725,038 A | | 3/1998 | Tucker et al. | |
| 5,853,274 A | | 12/1998 | Coffey et al. | |
| 5,918,652 A | | 7/1999 | Tucker | |
| 5,997,225 A | | 12/1999 | Young et al. | |
| 6,079,915 A | | 6/2000 | Bosten et al. | |
| 6,305,447 B1 | * | 10/2001 | Rousseau | 144/135.2 |

OTHER PUBLICATIONS

Instruction Manual—ROUT–R–LIFT™; Date—Unknown; pp. 1–4; JessEm Tool Company, 171 Robert St. E.#7 & #8, Penetanguishene, ON, L9M 1G9 Canada a Division of JessEM Products, Ltd.

(List continued on next page.)

*Primary Examiner*—W. Donald Bray
(74) *Attorney, Agent, or Firm*—McKee, Voorhees & Sease, P.L.C.

(57) ABSTRACT

An apparatus to support a hand held motorized tool in an inverted position that allows easy removal of the tool for hand held purposes. The apparatus is defined by a receiver in a frame and an opening for removal of the tool. A lid may further stabilize the tool. When mounted in the receiver the lateral and upper movement of the tool is restricted. When removed from the receiver the tool has attached to it only a sub base-plate that is comparable in size to the tool. The receiver may be removable or built into a tabletop.

36 Claims, 9 Drawing Sheets

OTHER PUBLICATIONS

Jesada Tools™; Catalog 51, Printed in Canada, Copyright © 2000, Jesada Tools, 310 Mears Boulevard, Oldsmar, FL 34677; 6 pages total namely: cover page; pp. 6 and 51 ("Rout R Lift"); p. 52 ("Multi–Ring Router Table Insert" and "Acrylic Offset bases") p. 54 (all); p. 55 ("The Handler").

Jesada Tools™; Catalog 52; Printed in Canada, Copyright © 2000; Jesada Tools, 310 Mears Boulevard, Oldsmar, FL 34677; 6 pages total namely: cover page; pp. 2 and 51 ("Rout R Lift"); p. 52 ("Multi–Ring Router Table Insert" and "Acrylic Offset bases") p. 54 (all); p. 55 ("The Handler").

ShopNotes Catalog; *Tool Talk—Tools of the Trade;* vol. 10, Iss. 56; Dtd. Mar., 2001, August Home Publishing, 2200 Grand, Des Moines, IA 50312, four pages total, namely: cover page; pp. 6–7 (all), p. 31 ("Rout–R–Lift").

* cited by examiner

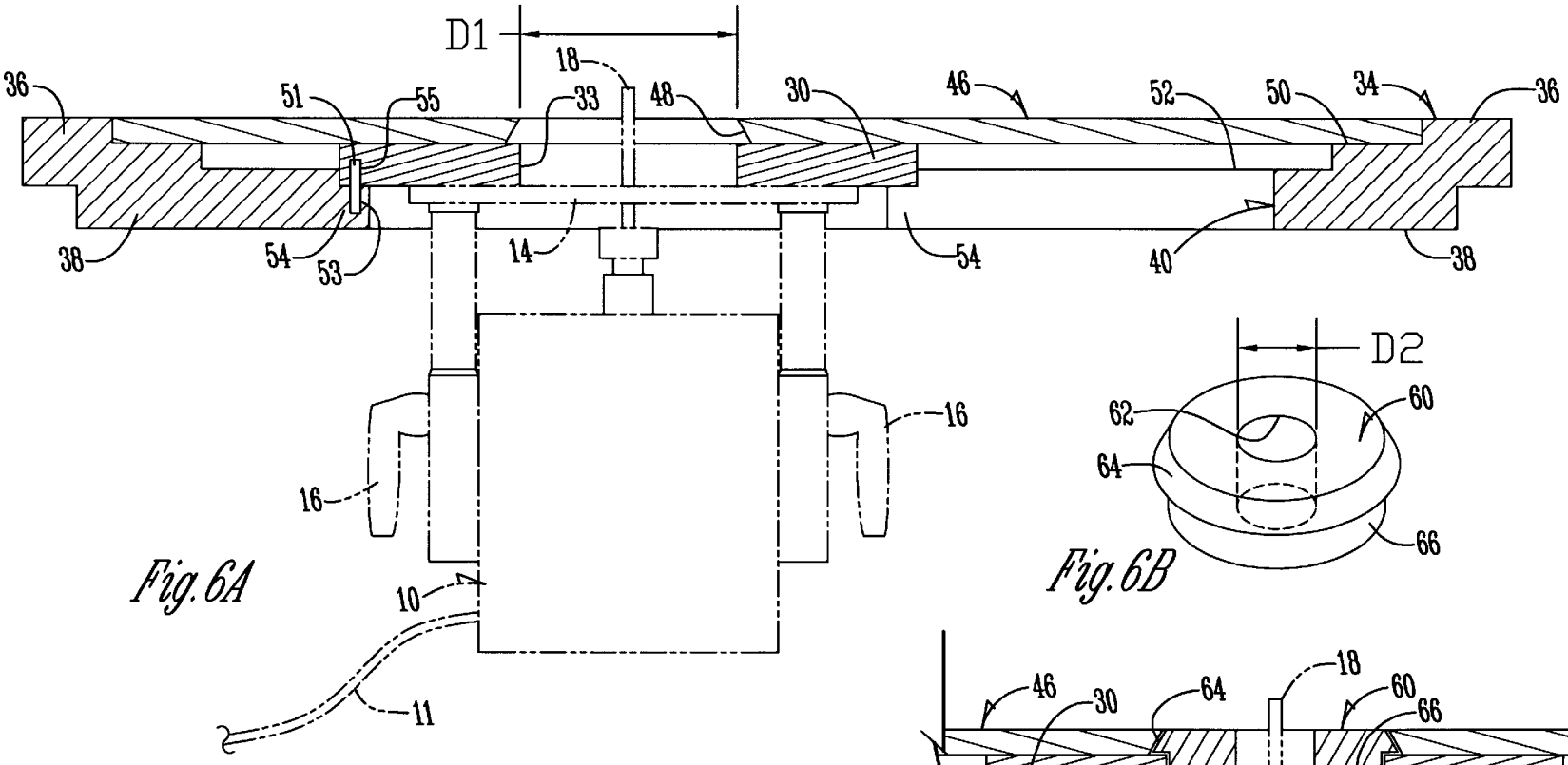
Fig. 6A
Fig. 6B
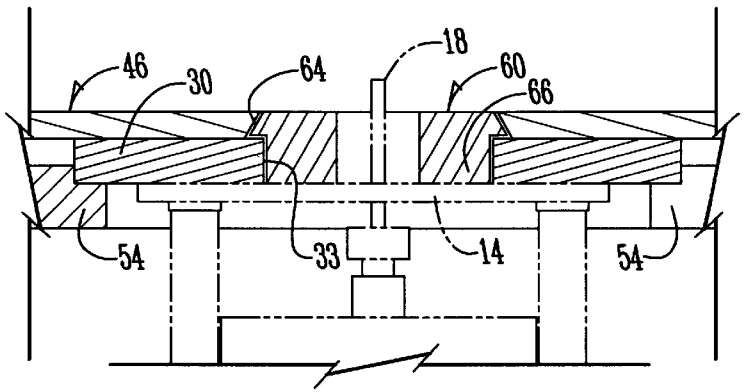
Fig. 6C

APPARATUS AND METHOD FOR MOUNTING ROUTERS IN TABLES

This application is based on U.S. Provisional Application Ser. No. 60/224,190, filed Aug. 9, 2000.

I. BACKGROUND OF INVENTION

A. Field of Invention

This invention relates to hand-held and operated tools such as to routers, jigsaws, spindle sanders, etc., and in particular to an improved mechanism and method for operably mounting such tools upside down into a tabletop or bench but allowing quick and easy removal for hand-held use.

B. Problems in the Art

Hand-held router tools are available in many sizes and designs. Various horsepower electric motors are encased in a housing to which handles are attached for holding and guiding the tool. A collet extending vertically and attached directly to the motor shaft allows exchange and securement of multiple profiles and shank diameters of cutting bits. Surrounding the collet and cutter is a base with a center opening sized to allow clearance for the cutter. The base is attached to the router housing through posts or by sleeving to the outside of the housing. Many hand-held routers have what is called a factory sub-base plate (e.g. a relatively thin plastic ring) of closely or identical diameter and shape as base 14, and attached to base 14 by machine screws. The factory sub-base (not shown) is usually of a material that does not have propensity to make scratches as the router is moved across a surface. It also acts as a sort of wear plate.

These types of routers are intended to be used hand-held, with the factory base/sub-base bearing against a workpiece and the cutter extending downward generally vertical in relation to the workpiece. The worker must move the router relative to the workpiece. This requires good coordination and control on the part of the worker to move the router in the desired manner.

Inverting the router position, with collet and cutter extending vertically up through a corresponding hole in a larger supported surface such as a table, can be advantageous. For example, this allows use of larger cutters, both horizontal and vertical, in relation to base. With cutters extending upward vertically and the router held stationary in a table top, the workpiece is controlled into a rotating cutter or bit, with the router stationary and not moving relative to workpiece. This type of router can sometimes be built-in to a table and therefore is not readily removeable and convertible to hand-held use.

Therefore, attempts have been made to create systems to allow hand held routers to be mountable for table use. The router can then be used in either hand-held or table-mounted mode.

Problems arise with such existing router table designs however. Usually the factory sub-base is removed and a substantial-sized, larger insert plate is mounted by bolts or screws to base of the hand-held router. The hand-held router, with attached insert plate, is inverted and set into a comparable sized receiving opening in a customized table. Phenolic or other plastics are commonly used as the insert plates. The insert plate is usually of a size, which permits the router and router handles to be lowered from the top through the accompanying and size-matching table hole. This can lead to insert plates that sag in the center due to the constant weight applied by the router and the substantial size of the insert plate. These types of plates are also undesirable when using the router in hand-held mode. The size (usually substantially larger than the hand-held router base) and/or shape (many times square or rectangular) obstructs free turning and positioning of the router in hand-held mode, when following templates or straight guides, or when working in limited access areas and, at a minimum, is quite different from the factory base and factory sub-base, and thus makes it difficult to use the router for all its factory capabilities. If a worker is restricted to one router, switching from table use to hand use leaves either an unwieldy added insert plate, or requires time consuming changing of the insert plate to the factory base or base-plate of the router. Therefore, there is room for improvement in the art relative to table support of hand-held routers.

For example, refer to FIGS. 1 and 2. An existing method of converting a hand-held portable router 10 into a table-mounted tool is illustrated. Conventional hand-held routers 10 have a housing 12 encasing a motor, a base plate or plates 14 attached to housing 12 by posts or sleeves 21, handles 16, and a bit 18 removeably positionable in a bit collet or chuck 17 which is rotatable by the electric motor and extendable through opening 19 in base plate 14. An electrical cord 11 supplies connection to an electrical power source.

As illustrated in FIGS. 1 and 2, one state of the art way of converting the hand-held router 10 to a table top tool is to configure a table 20 (see FIG. 2) to include a relatively large rectangular opening 26 with a flange or ridge 28 smaller in perimeter dimensions than opening 26.

A relatively large plate 22 having an opening 23 for bit 18 is mounted by bolts or screws 24 to base plate 14 of router 10 (usually after removal of a factory sub-base). Plate 22 has an outside perimeter which mates into receiving opening 26. Flange 28 supports plate 22. Note that router 10 and plate 22 are inverted and pass into and through opening 26 when mounted into position, so that plate 22 is flush with table top 20. (See FIG. 2).

Once inserted into table 20, cord 11 is connected to appropriate circuitry for access to electrical power, and what was the hand-held portable router 10 now functions as a table mounted tool with bit 18 extendable above the surface of table 20. As can be appreciated, plate 22 sits flush in table 20, to the extent possible. Also, as can be appreciated, fences can be adjustably positioned on tabletop 20 to assist the woodworker when manipulating work pieces to bit 18.

As previously mentioned, the size of plate 22 is usually sufficiently large to support router 10, but also allow handles 16 and housing 12 to pass through table surface 20 when mounting it, and also pass back through when removing router 10 with attached plate 22. Thus, the size and dimensions of such plates 22 are substantially larger than the factory base 14 and factory sub-base, and many times are square or rectangular which is much different than round, and not very conducive to hand-held routing.

This combination makes it very cumbersome and even difficult to then use router 10 in a hand-held portable mode because of the substantial size of plate 22 and many times because of the non-round shape. Removal of plate 22, to convert router 10 back to hand-held mode (and reattachment of factory sub-base), is time consuming and cumbersome, but may be necessary for accurate use of router 10 in a hand-held mode.

Router fences of various designs are often used to set depth of cut and/or add stability to the workpiece. Normally, such fences attach to or across a substantial part of the tabletop and are moveable from very near to the bit to a position away from and towards or near the edge of the tabletop. With the design of FIGS. 1 and 2, removal of the fence is necessary for most cutter bit changes, and for removal of the router from the table.

A mechanism and method is needed allowing a router of almost any size or design to be quickly and easily exchanged from the top of a table, with no fence removal, ready for hand held use with a base plate of generally the same design and feel as its factory base plate.

The same or similar problems exist for many other hand-held tools. Examples are jigsaws, drills, spiral saws, spindle sanders, or other tools having a working member extending downwardly or generally vertically through an integral base plate when in a hand-held and operated mode.

II. SUMMARY OF THE INVENTION

The present invention relates to an apparatus which fits into the top of an existing table, or becomes a self contained table allowing hand-held routers or other tools of a variety of sizes, designs and horsepower to be quickly installed or removed from the table or table top allowing use of the tool in an inverted table-mounted position, with working bit above table surface and the tool stationary relative to the table top surface. Removed, the tool can be used, losing no factory functions, and is not limited by an undesirable and often unusable enlarged base-plate.

A frame includes a receiver into which can be placed and supported the inverted tool, for example, by its factory base, factory sub-base, or substitute sub-base plate. Thus, the advantages of being able to convert the hand-held tool into a table mount tool is provided, with the advantage that when needed as a hand-held portable tool, the limitations and disadvantages of having a substantial sized plate, such as plate 22 of FIGS. 1 and 2, is avoided.

The frame can either be a separate apparatus insertable into a table (such as substantial opening 26 of FIG. 2) or can be built into a table.

In some embodiments, the invention utilizes a relatively small substitute sub-base plate, which is removeably attachable to the tool (in place of the factory sub-base plate) and is not much larger or different in perimeter dimensions than the factory base-plate of the tool.

Additionally, a cover piece can be adapted to overlay the tool, when in inverted table-mounted position in the frame, to help hold the inverted tool in place and provide a smooth top surface for matching the surface of the table. The cover piece can be a separate piece or hingeable or pivotable down over the inverted tool when placed into the frame.

III. BRIEF DESCRIPTION OF THE DRAWINGS

FIG. 6A is an enlarged sectional view taken along line 6A—6A of FIG. 5.

FIG. 6B is a perspective view of an insert ring optionally usable with the embodiment of FIGS. 3–6A.

FIG. 6C is a partial sectional view similar to FIG. 6A showing use of the insert ring of FIG. 6B.

IV. DETAILED DESCRIPTION OF EMBODIMENTS OF THE INVENTION

A. Overview

Figure 1:
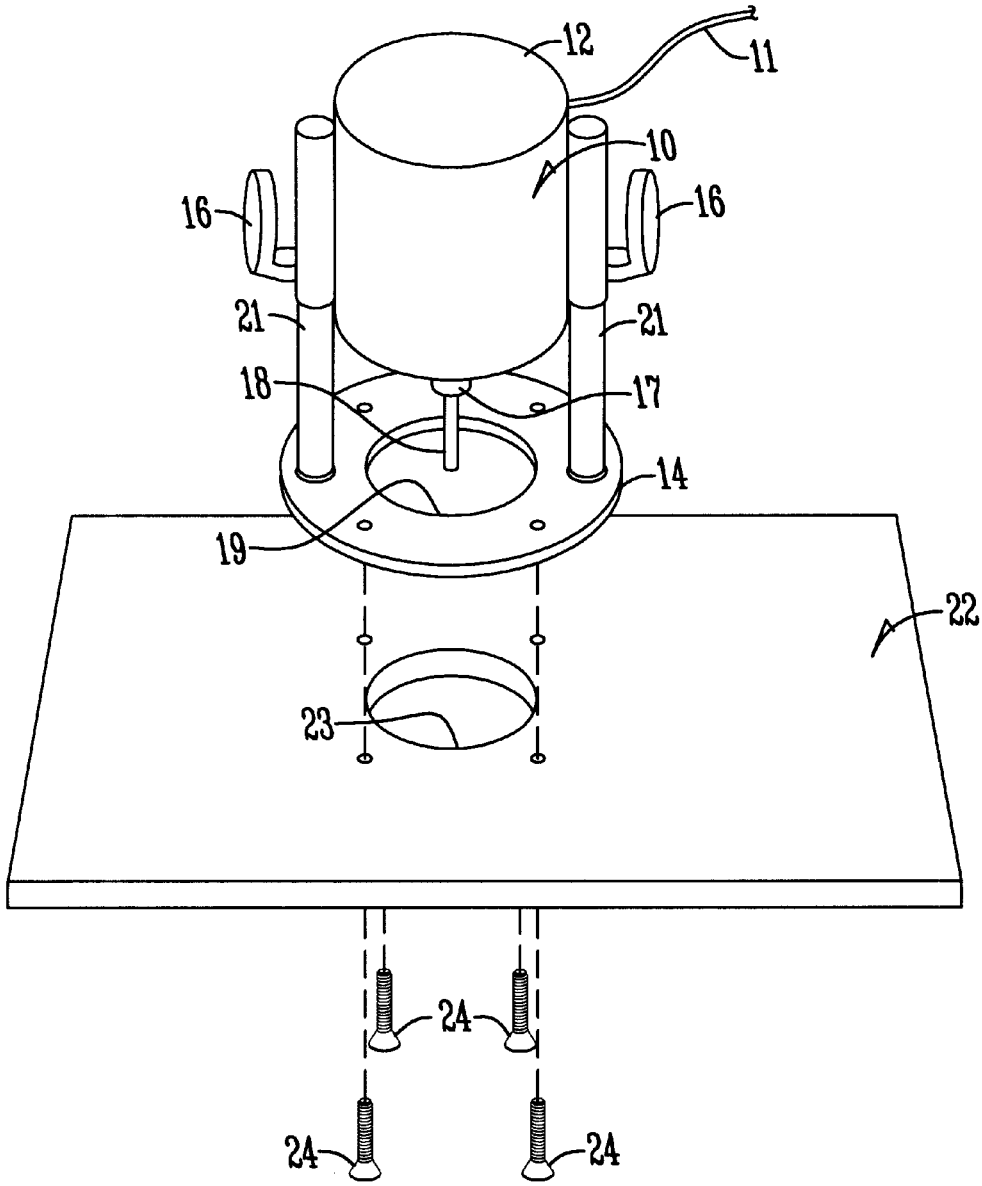
Fig. 1 (PRIOR ART)
FIG. 1 is a perspective view of a conventional hand-held router in conventional bit-down hand-held orientation with a conventional add-on table-mount insert plate shown exploded from the router, according to the prior art.

For a better understanding of the invention, embodiments thereof will be described in detail herein. Frequent reference will be made to the drawings. The drawings include reference numerals, which indicate certain parts and locations in the drawings. The same parts or locations will use the same reference numerals throughout the drawings unless otherwise indicated.

As previously stated, the invention is applicable to hand-held portable routers, but also to other types of tools of analogous nature. These detailed descriptions will be with respect to routers, but as will be appreciated by those skilled in the art, can be similarly applied to other tools of analogous nature.

Figure 2:
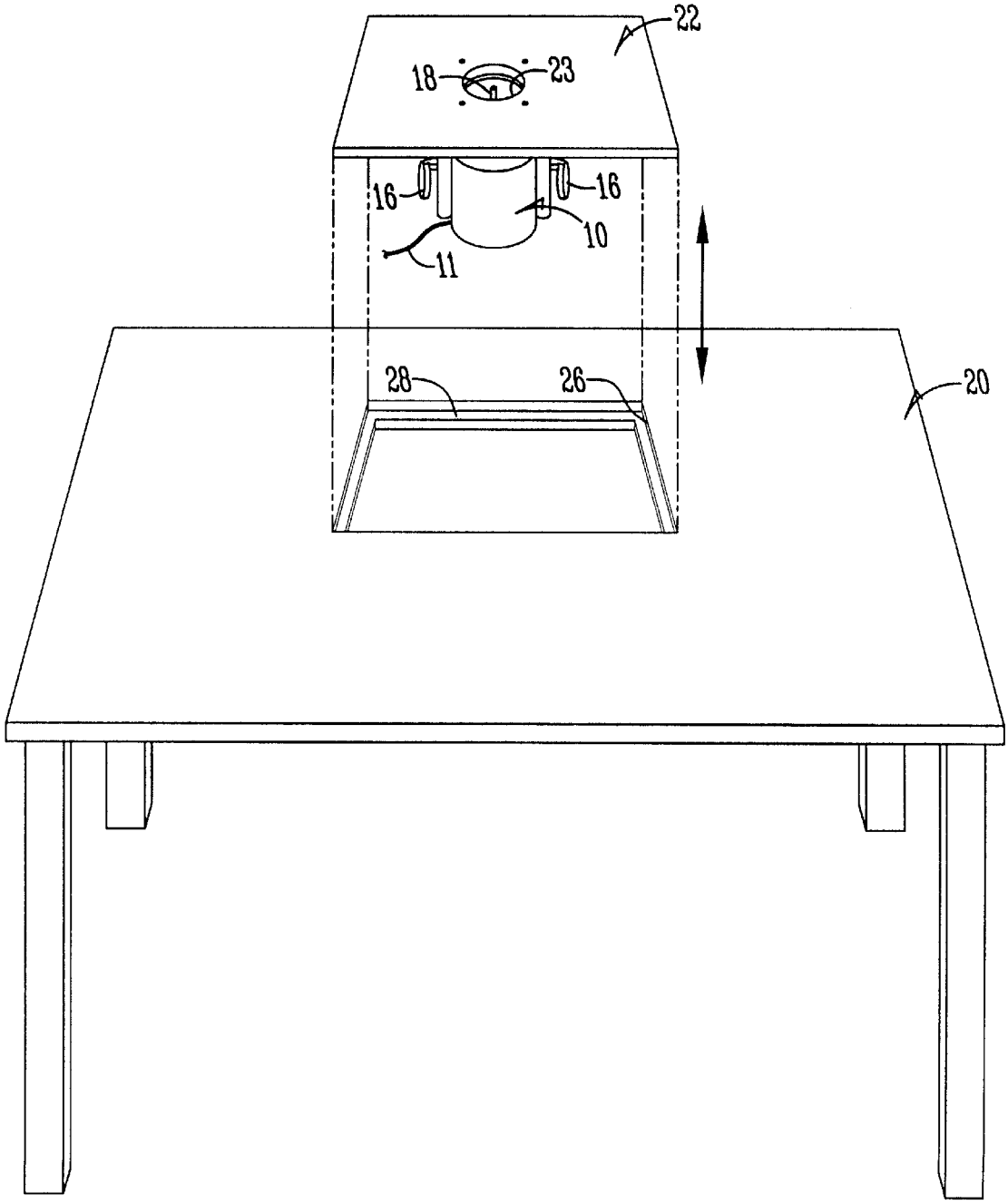
Fig.2 (PRIOR ART)
FIG. 2 is a reduced perspective view of the router of FIG. 1 with conventional table-mount insert plate attached, all in position to be dropped into a substantial sized opening in a router table adapted to accommodate the router and router insert plate combination of FIG. 1, according to the prior art.

As previously described with regards to FIGS. 1 and 2, conventional hand-held router 10 has a factory base-plate normally about 6 inches or so in diameter and perhaps 8 to 12 inches in total length. A factory sub-base (not shown) is usually almost or identical in size or shape to factory base 14 and is, e.g., ⅛" to ¼" thick and of plastic or other material that does not or is not likely to scratch surfaces it moves over. A conventional prior art solution to converting hand-held router 10 to table mount tool involves removal of the factory sub-base and attachment of a substantially sized plate 22 attached to router 10. Plate 22 can be of a size substantially greater in perimeter dimensions than router 10 or its factory base plate 14 (e.g. 12"×10"). It can be appreciated by those in the art that this makes it cumbersome to utilize router 10 in a hand-held mode when plate 22 is attached.

B. Structure of a First Embodiment

Figure 3:
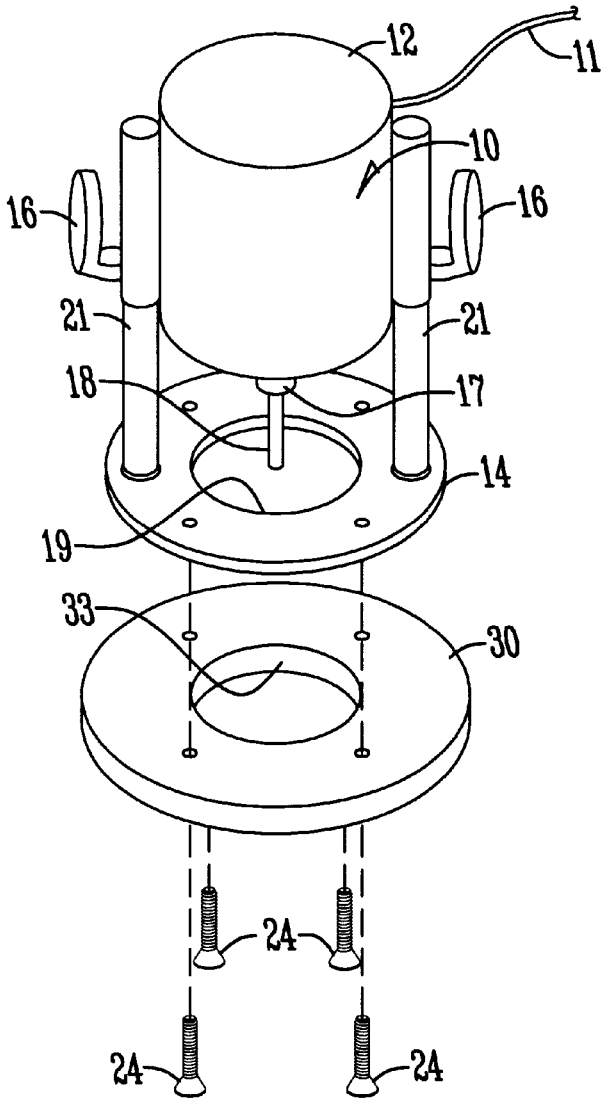
FIG. 3 is similar to FIG. 1 but shows a substitute sub-base according to an embodiment of the invention exploded from the router.
Figure 4:
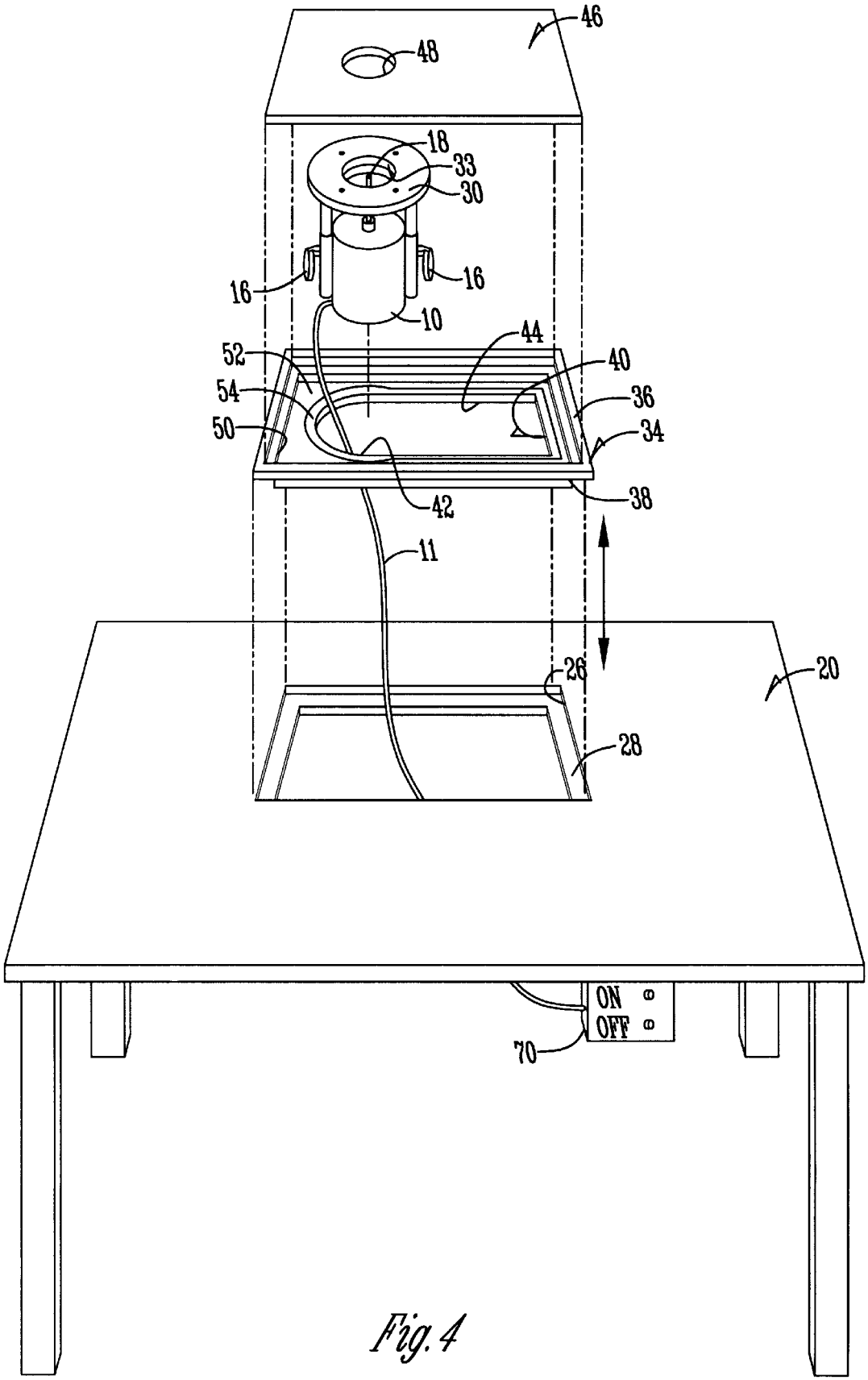
FIG. 4 is similar to FIG. 2 but shows in exploded form an embodiment of the invention usable with the assembled combination of FIG. 3 and a table and opening such as illustrated in FIG. 2.

FIGS. 3 and 4 show a first embodiment according to the present invention. Instead of the substantially sized plate 22 such as shown in FIGS. 1 and 2, a substitute sub-base 30, for example of ring-like construction (approx. 8" O.D.), replaces factory sub-base and has a central bit opening 33 and spaced apart apertures through which screws or bolts 24 can affix sub base 30 to base 14 of router 10 (usually with the same screws and threaded holes used to attach the factory sub-base to base 14).

As is intended to be illustrated in FIG. 3, sub-base 30 is not much bigger (approx. 8" in diameter) than the perimeter dimensions of factory base plate 14 of router 10 (approximately 6"–7"). It is also relatively thin and (on the same order of thickness or not much more than the factory sub-base) therefore, even when attached, router 10 retains substantially the same characteristics, size, and shape as conventional router 10 and therefore should be able to perform all functions possible with the factory hand-held router. It therefore can easily be used in a hand-held or portable mode without the limitations and compensations required of the combination shown in FIG. 1.

FIG. 4 illustrates how the combination of FIG. 3 could be inserted for use in a table 20. In this embodiment, a frame or adapter ring 34 (approx. 11⅞" wide by 14⅞" long×¾" thick), having an outer portion 36 and a lower portion 38, is sized to mate into and be supported into opening 26 in table 20. Opening 26 can be the same opening 26 shown in FIG. 2, so that this embodiment of the invention could be retro-fitted or used with tables originally adapted to receive the router 10/plate 22 combination of FIG. 1. It is to be understood that the shape and size can vary within the spirit of the invention. Outer or upper portion 36 of frame 34 would essentially matingly fit into opening 26 and rest on ledge or flange 28 in table 20. Lower portion 38 of frame 34 would fit through the opening defined by inward extending flange 28 in table opening 26. Thus, outer or upper portion 36 of frame 34 would rest upon flange 28 and thus be insertable but removable from the table 20. It is to be understood that in this embodiment, the upper surface of outer or upper portion 36 of frame 34 could be sized to be flush with the plane defined by the top of table 20.

Figure 9:
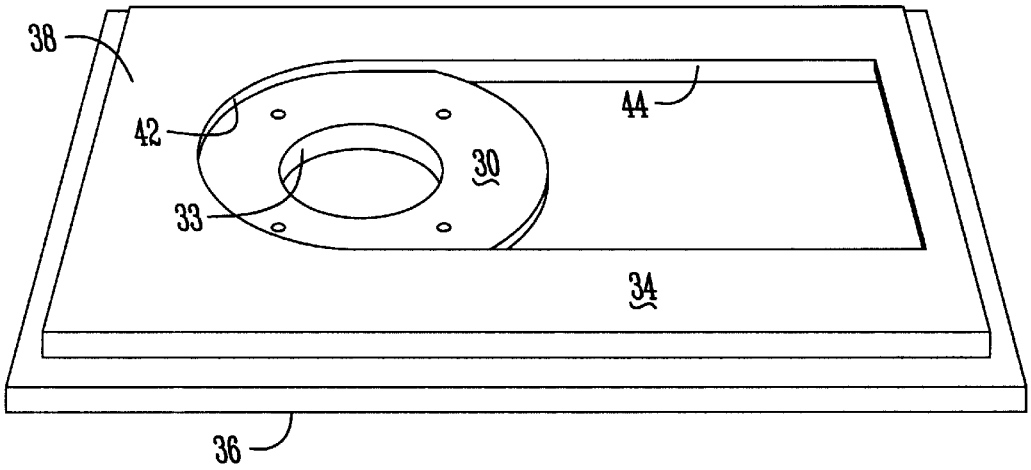
FIG. 9 is a bottom perspective view of FIG. 7.
Figure 10:
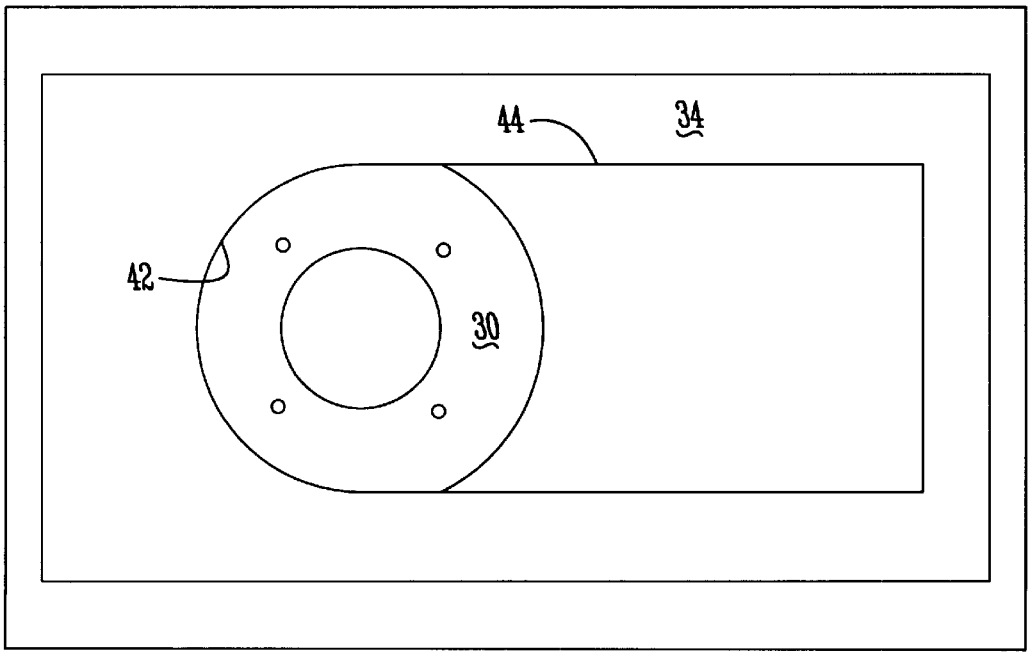
FIG. 10 is a plan view of FIG. 9.

Additionally, frame 34 has a receiving opening generally indicated by reference numeral 40 (approx. 7" wide×12⅛" long). Receiving opening 40 includes a circular portion 42 (approx. 7¾" dia.) and a rectangular portion 44 (best seen by referring to FIGS. 7, 9, and 10). Circular portion 42 is surrounded by a cutout or receiver (ledge 54 and wall 55) sized to matingly receive sub-base 30. Inwardly extending ledge or flange 54 (approx. ¼" wide) supports sub-base 30. Circular opening portion 42 has a diameter smaller than the outside diameter of sub-base 30, but in combination with rectangular portion 44, is big enough to allow passage of router 10. Note that sub-base 30 is bigger than factory base 14 or router 10 including its handles. Ledge 54 is dimensioned to receive and seat portions of sub-base 30 that extend outside base 14.

However, it is to be understood that in some circumstances, sub-base 30 is not needed. Tool 10 could be received by and seat into a receiver by its own original structure, e.g., original base plate 14 and/or original factory sub-base. If a substitute sub-base 30 is used, preferably it is not much bigger than the factory sub-base to retain the functions of the factory router. However, here, substitute sub-base 30 is sized to work with and be slightly larger than most factory bases 14 so that one substitute sub-base 30 can be used with a variety of makes and models of tools.

If substitute sub-base 30 us used, the diameter of sub-base 14 generally can be sufficient as to allow for a lip extending past all known router base 14 diameters. This would allow one sub-base 30 to be used for a variety of different routers. However, different sized sub-bases 30 could be made and used, if desired. Sub-base 30 could be affixed to the router base 14 and centered on the router collet or chuck holding bit 18. Alternatively, it may be part of an entire one-piece replacement base containing and including locations for all existing router accessories and functions. Sub-base 30 can be pre-drilled, or drilled by template and affixed to router base 14 with factory-supplied screws or bolts 24. If a one-piece replacement base (both factory base and sub-base), it may include plunge router posts, or accept factory base posts.

Rectangular portion 44 of receiving opening 40 is also big enough to allow passage of housing 12 and all parts of router 10 which allows the operator to reach, grasp and tilt router 10 with sub-base 30 attached for easy insertion and removal of router 10 to and from the table mount mode. In FIGS. 7–10, for simplicity, sub-base 30 is shown without router 10. Wall 55 retains sub-base 30 (and thus router 10) from lateral movement, as it extends greater than 180°, but it terminates at or near the beginning of rectangular portion 44, so as to allow easy reach through and tilting of router 10. Ledge 54 prevents sub-base 30 (and thus router 10) from downward movement. Also, when seated in the wall 55/ledge 54 receiver, sub-base 30/router 10 will hang down and upward movement will be resisted by gravity.

Figure 7:
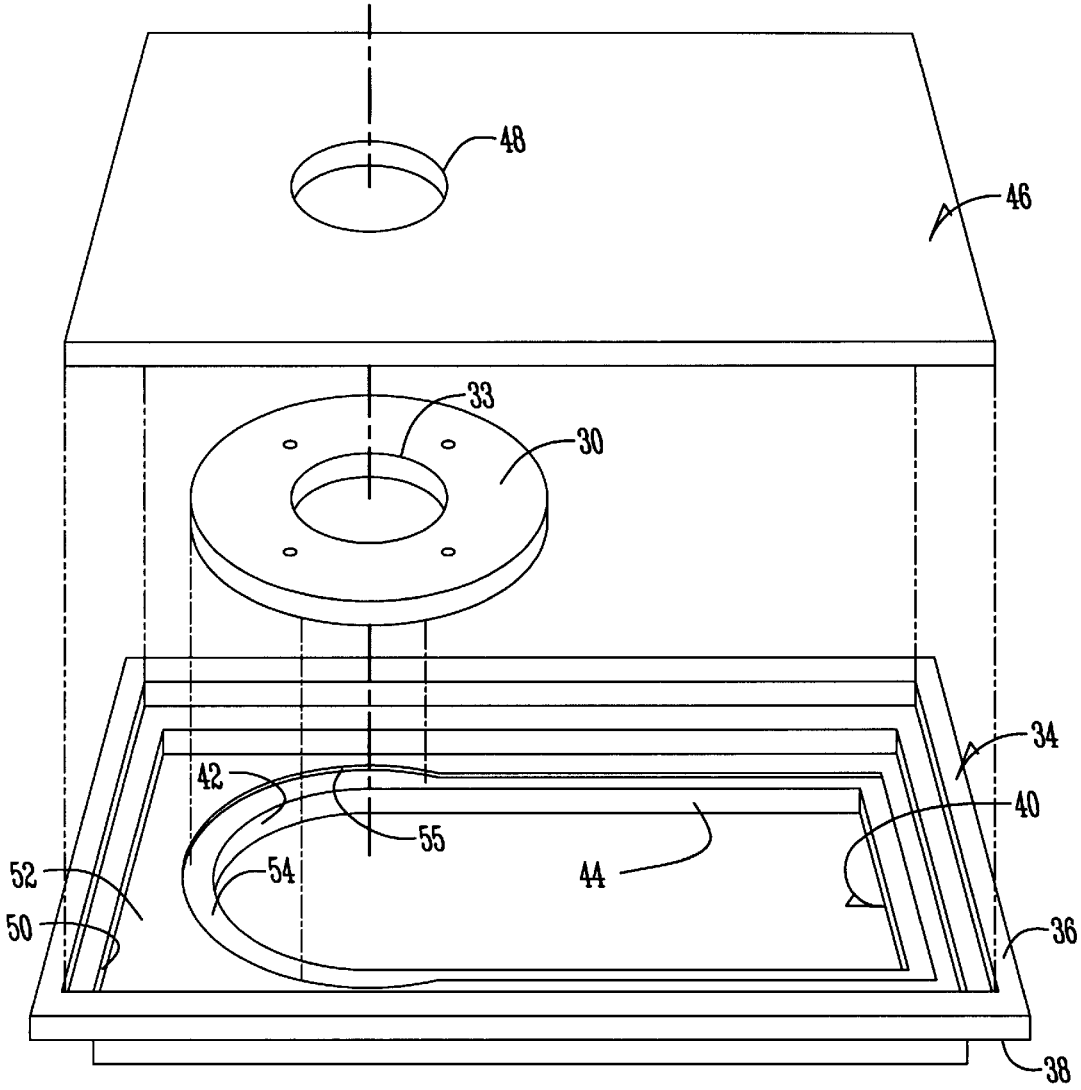
FIG. 7 is an enlarged isolated exploded perspective view of components of the embodiment of the present invention shown in FIG. 4.
Figure 8:
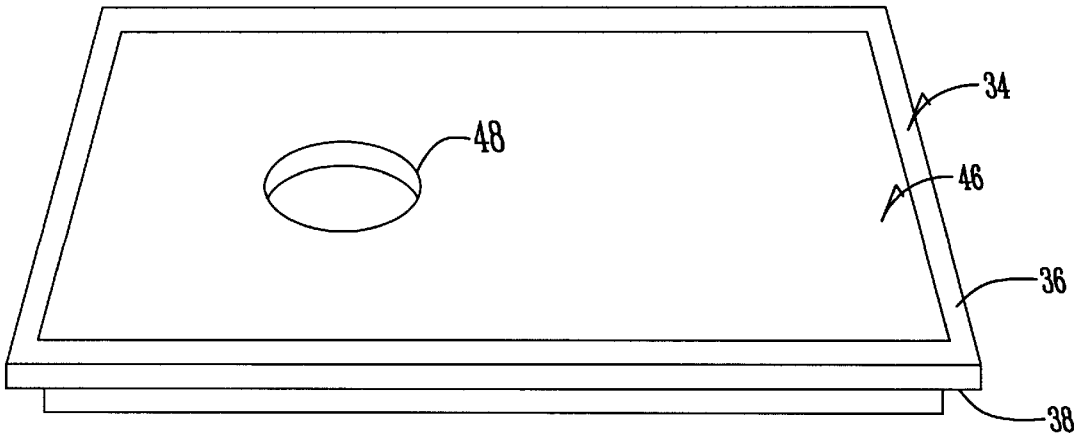
FIG. 8 is an assembled view of the components of FIG. 7.

Optionally, an overlay or lid 46 having an opening 48 removeably mates within a recessed portion of outer portion 36 of frame 34 and is supported therein (see FIGS. 7 and 8). Opening 48 aligns with circular opening 42 in frame 34 such that bit 18 of router will be generally centered therein and extend therethrough above the surface of lid 46. It is to be understood that the top surface of lid 46 would essentially be configured to lie in the top of table 20 so that lid 46, outer portion 36 of frame 34, and the top of table 20 are all generally coplanar.

Figure 5:
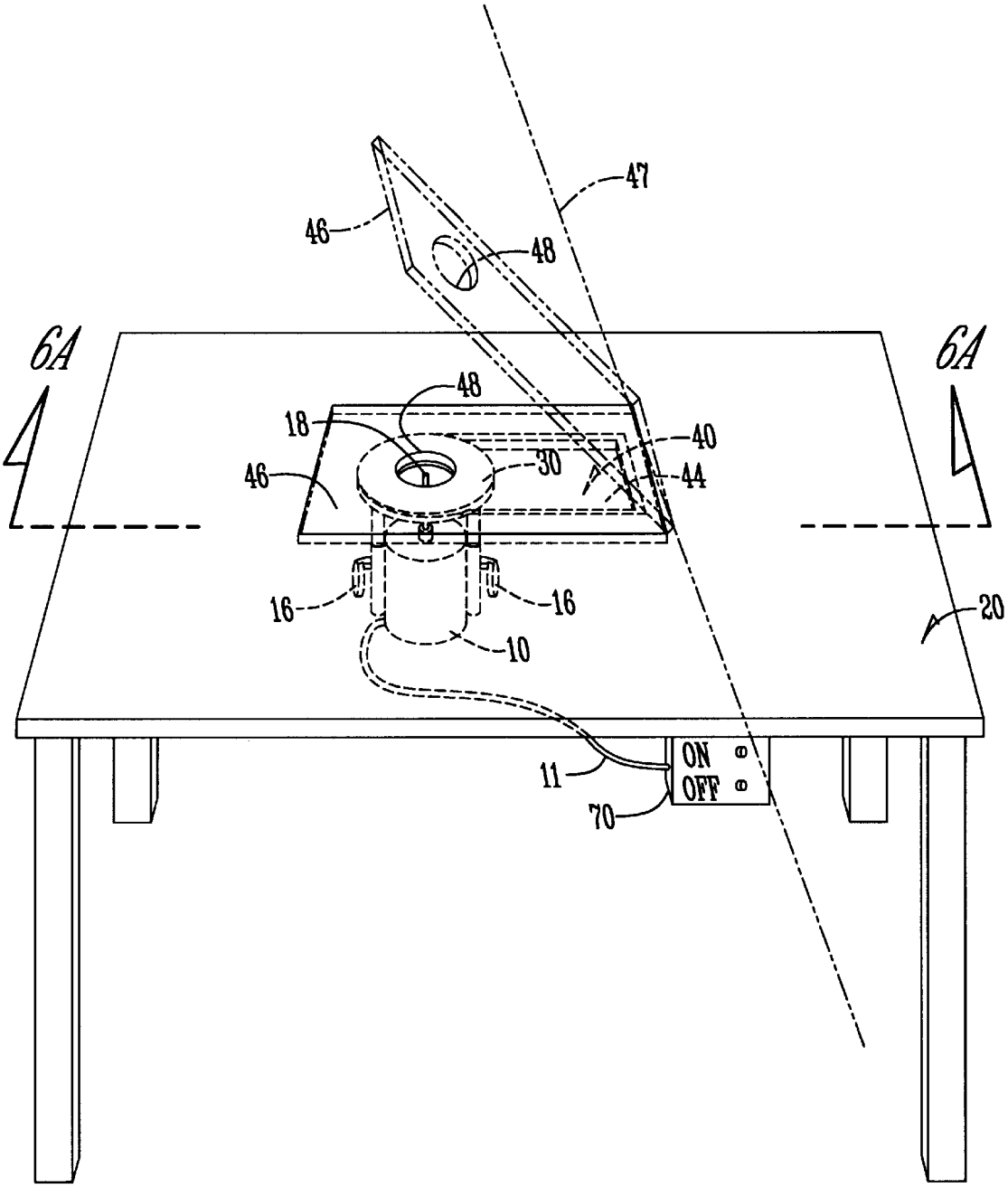
FIG. 5 is an assembled view of FIG. 4 and the independent removeability of a cover 46 (see ghost lines).

FIG. 5 illustrates components of FIG. 4 in assembled position. The hand-held portable router 10 is now inverted and held in position for tabletop use. The configuration presents a top surface flush with top surface of table 20 with opening 48 allowing bit 18 to extend above that surface for use as a tabletop mounted tool. Sub-base 30 and router 10 are below tabletop level (see ghost lines). Then, by using, for example, lid 46, there are no exposed screws or screw holes, presenting a flat and smooth surface.

Thus, this embodiment preserves the ability to quickly and easily remove router 10 for hand-held portable use, or be inserted into a table top for table use.

FIG. 6A illustrates in more detail the precise inter-relationship of sub-base 30, frame or adapter ring 34, and overlay 46 when in assembled form shown in FIG. 5.

Note that some form of rotation deterrence can be used. For example, see FIG. 6A. A pin 51 (e.g. steel) can be press-fit or otherwise mounted into a mating bore 53 in ledge 54 and extend generally perpendicularly from ledge 54. A bore 55 can be formed in the bottom of sub-base 30 which is deep enough to receive the exposed part of pin 51 and allow sub-base 30 to seat onto ledge 54. When sub-base 30 is moved into circular portion 42 of opening 40 to seat it on ledge 54, pin 51 can be aligned with and enter bore 55. This arrangement would deter rotation of sub-base 30, and thus router 10 when seated into the receiver. Thus, not only is router 10 held against lateral movement or downward movement, it is held against rotation.

Alternative rotation resistance methods can be used. For example, but not by way of limitation, notches, clamps, or other structures can be used. Furthermore, friction between sub-base 30 and ledge 54 can be used. To increase friction, a high friction surface or surfaces could be used (e.g. rubber, corrugation).

Such an arrangement also can be used as an indexing method, to ensure the tool is always aligned in the same way when inserted for tabletop use. Alternatively, for indexing, alignable indicia such as lines or matching dots or etches on frame 36 and sub-base 30 can be used. Such indexing can be useful, including for consistent placement of tool switches or controls relative the user.

For router table use, the perimeter of sub-base 30 in the perimeter of a portion of tool 10 is suspended on annular lip or ledge 54 located a distance below the tabletop surface equal to the combined thickness of the sub-base 30 (or tool portion) and overlay or lid 46. Lid 46 optionally could be hinged in frame 34 (see hinge axis 47 in FIG. 5), and open vertically relative to the horizontal base-plate (see lid 46 in ghost lines in FIG. 5). The ledge 54 on which sub-base plate 30 or tool 10 is suspended, may be formed in an insert frame 34 of sufficient size to allow routers, jigsaws, oscillating spindle sanders etc. to be lowered into and suspended with no external removal of handles or any modification.

Insert frame 34 can have an external lip 36 around its perimeter. This insert lip 36 will rest into and suspend on a lip or ledge 28 formed in a larger surface, such as table 20 top surface of, e.g., plywood, particleboard, plastic, melamine. When suspended in table 20, the insert frame 34 is preferably level relative to the larger table 20 top surface.

A secondary lip or ledge 50 can be formed in frame 34, inside of, lower than, and parallel to the external lip or ledge 36 and in opposite direction relative to the external lip or ledge 36, to support top, lid, or overlay 46 of equal size and shape and thickness as to be level with the insert frame 34 and larger table top 20. Thus, the depth of ledge 50 is approximately equal to the thickness of lid 46. Note that in this embodiment, sub-base 30 is thicker than the depth of ledge 54 from surface 52, but when supported on ledge 54, the top of sub-base 30 would also support lid 46.

Top or lid 46 can be pinned or hinged at one end allowing it to open vertically and separately relative to the insert frame 34 and larger tabletop 20. The hinging top or lid 46 allows access to the router or tool, for removal or installation. When resting on the lip or ledge 50 of the insert frame 34, the top or lid 46 also helps secure and retain the router sub-base 20 by sandwiching it between it and surface 54 of insert frame 34.

Hinged opening 48 of lid 46 can be beveled through its thickness as shown in FIGS. 6A and 6C. The smaller diameter of opening 48 is located at top surface lid 46. The larger diameter of opening 48 is at the bottom side of lid 46 and is centered relative to opening 33 of suspended base-plate 30 when lid 46 and router 10 are in table mode position as in FIG. 6A. This opening 48 allows clearance for cutter bits 18 to extend from the router collet vertically in relation to table 20 top surface.

As the lid cutter opening 48 is relatively large, this size may require reduction allowing for workpiece support, when smaller diameter cutter bits are used.

As shown in FIGS. 6B and 6C, a reduction ring 60 can be placed in opening 33 of sub-base 30. When lid 46 is placed into position, the mating beveled top of reduction ring 60 fits into beveled opening 48 and is held in position. Reduction ring 60 can have an outer edge 64 tapering in size, matching the bevel and thickness of the beveled opening 48 in lid 46. Bevel 64 on reduction ring 60 can have a relative thickness to the lid 46, so when the two are engaged, the top of the reduction ring 60 is level relative to the lid 46. The beveled reduction ring 60 can include a lower portion 66 directly under its largest diameter of the tapered edge 64. This portion 66 can be of a diameter, to mate into or press fit into center hole 33 of the sub-base plate 30 suspending router 10. If lid 46 is hinged up vertically, this insert reducer ring 60 will remain engaged to the router sub-base 30.

The extended cutter 18 may rotate and engage workpieces lying on top hinged lid 46, insert frame 34 and table 20 surface. Work pieces can be manipulated into the cutter 18 relative to the stationary router, which does not move relative to the insert frame 34 or tabletop 20.

Reduction ring 60 thus provides the option of a smaller opening 62 through which a bit 18 can extend depending on circumstances. As can be understood, opening 62 in reduction ring 60 can be of any desired size. A variety of reduction rings 60 could be on hand with different openings 62 for different situations.

Hinged lid 46 can be drilled to accept a fence. The fence can adjust parallelly relative to the vertical line or edge of cutter bit 18. When lid 46 is hinged vertically in relation to table 20 top surface, the fence will also hinge vertically, and thus does not require removal or adjustment.

Thus, as can be seen, the combination shown in FIGS. 3–10 preserves the functionality of a hand-held portable router while allowing it to quickly and easily be converted into a table top mount. Frame 34 can mateably mount into an existing substantially large opening 26 in existing router tables or frame 34 could be made larger or smaller for a specific sized opening in a table.

Different materials can be used for the components described herein. For example, top lid 46 can be wood, metal, phenolic plastic, or other materials. Reduction ring 60 can likewise be made out of plastic or other materials. Sub-base 30 can be made of plastics such as wood, metal, acrylics, lexon, or the like, or other types of plastics, or other materials.

Insert 60 can be made of molded or injected plastics, other plastics, or metals such as aluminum. Other materials are possible.

The dimensions of the components can be constructed as needed. An example of the size of opening 48 could be approximately 4" in diameter with a 15° downward bevel from vertical.

C. Structure of Second Embodiment

Figure 11:
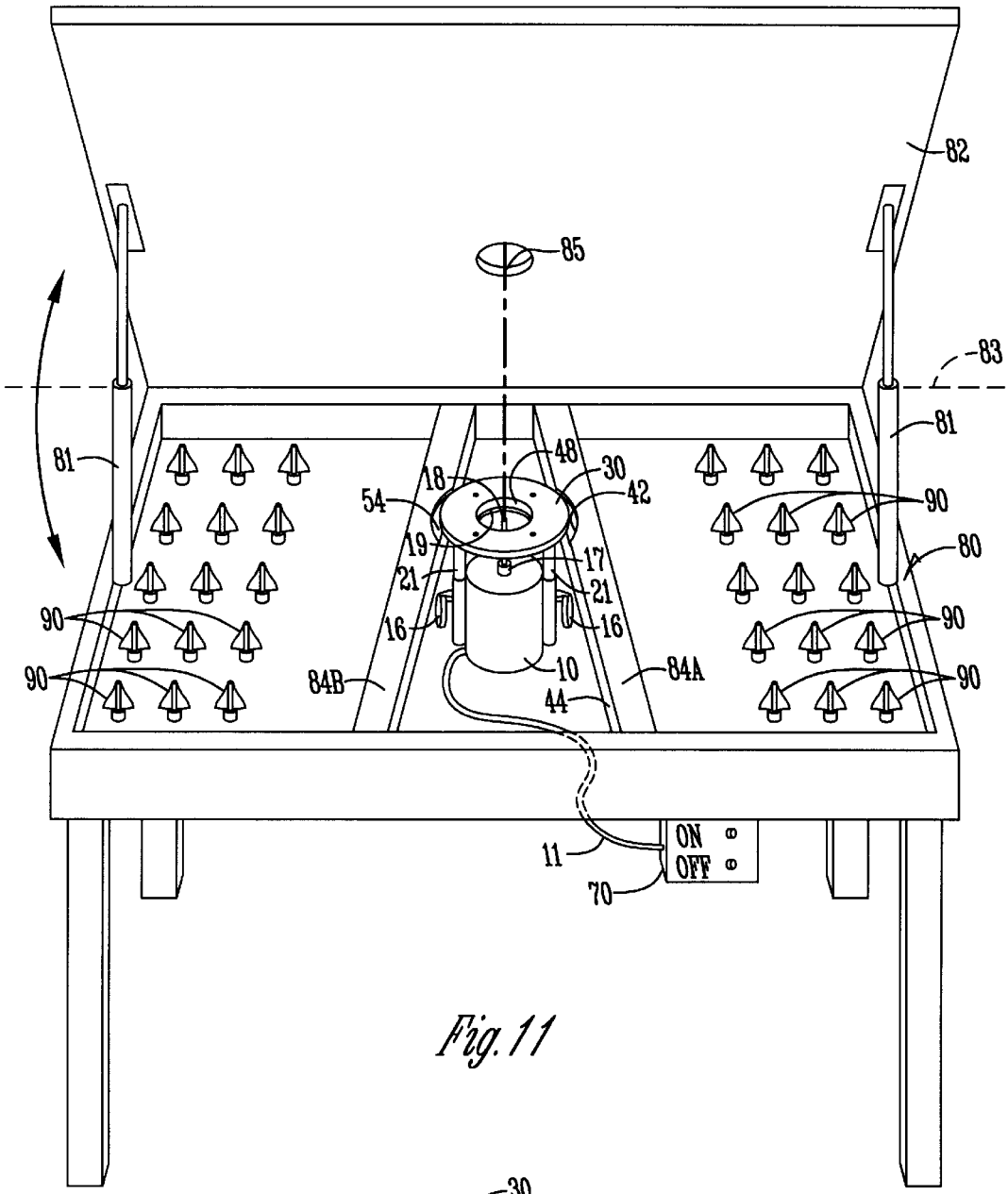
FIG. 11 is a perspective view of an alternative embodiment of the present invention.

FIG. 11 illustrates an alternative embodiment according to the invention. Instead of a removable insert frame 34 such as shown in FIGS. 3–10, a table 80 could include built-in frame members 84A and B that have facing edges configured to match the configuration of the edges of opening 40 in insert frame 34 in FIGS. 3–10. Sub-base 30 could fit into and be supported in the circular portion 42 defined by frame members 84A and B. Rectangular portion 44 of the opening between frame members 84A and B can function to allow router 10 and sub-base 30 to be easily accessed, grasped, tilted and inserted into or removed out of table 80.

As illustrated in FIG. 11, the entire tabletop 82 could be hinged and supported by supports 81 (such as well-known pneumatic or fluid filled extendable pistons). An opening 85 (like opening 48 in lid 46) in table top 82 would be centered over circular opening portion 42 defined by frame members 84A and B, through which router bit 18 would extend when table top 82 is pivoted down to horizontal. Such a table 80 could include interior trays or spaces in which different router bits 90, or other supplies or equipment can be stored.

The embodiment of FIG. 11 again provides for quick and easy conversion of router 10 from hand-held portable mode to a tabletop mode while preserving essentially the same characteristics of hand-held. Circular portion 42 of the opening in frame 84A/B is a receiver for router 10 and/or sub-base 30 portion. It suspends router 10 and does not allow lateral or downward movement. It deters upward movement because of the weight/mass of router 10 is below the plane of sub-base 30. Optionally, it could use additional rotation deterrence, such as previously described with respect to the first embodiment. However, circular portion 42, with other portion 44 also allows easy access to and insertion and removal of router 10. Lid 82, when closed, help hold router 10 in place by deterring upward movement.

D. Options and Alternatives

It will be appreciated that the present invention can take many forms and embodiments. Variations obvious to one skilled in the art will be included within the invention.

For example, the precise configuration and dimensions of components described herein are illustrative and exemplary.

One option that may desirable is to have upward projections or essentially bumps (not shown) along the shoulder or ledge 50 on which lid 46 sits. This would help insure lid 46 sits down and is supported by those bumps or structures and deters the buildup of sawdust that might cause uneven placement of lid 46 onto frame 34 or frame members 84A and B. Similar wings or projections could be used between other mateable parts.

Figure 12:
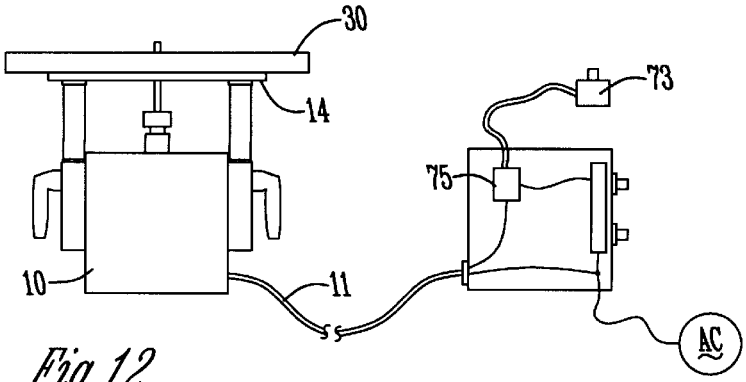
FIG. 12 is a schematic and diagrammatic illustration of electrical circuitry usable with the embodiments of FIGS. 4 and 11.

Additionally, a power disconnect such as shown in FIG. 12 could be useful with the invention. A micro-switch 73 could be placed in line with the power on/off switch such that it trips relay 75 when either top lid 46 or tabletop 82 is raised. Relay 75 would cut power to router 10 so that it would be impossible for router 10 to operate when exposed in that manner.

The sub-base plate of invention can be of a variety of shapes and can be of a variety of materials (e.g. plastic, steel, aluminum or other materials). Use of sub-base 30 is preferred because one sub-base could be used for a variety of types and models of tools. A user could attach a sub-base 30 to each of a number of different tools and easily exchange them in table mount fashion. Or multiple tools of the same type could be set up differently and each have a sub-base 30 attached so as to be quickly and easily available for table top use interchangeability, without having to remove and install a sub-base 30 each time that tool is to be used.

However, as stated previously, the invention can be implemented without sub-base 30, using a portion of the tool itself to suspend the tool in the receiver. As used herein, unless otherwise obvious from the context, the term "portion of the base" is intended to mean not only a portion of an original, unmodified tool, but also a modification that does not substantially expand the size of the original tool or the nature of the original tool. By way of example, but not limitation, refer to sub-base 30 of the drawings. Sub-base 30 is a substitute or modification to original router 30. It replaces the factory or original sub-base for the router. However, it is closely similar in size and nature to the original factory sub-base, e.g. in comparison to, for example, insert plate 22 of FIGS. 1 and 2. As noted previously, at least for routers, they usually have a factory or original base plate surrounding the bit and collet, and a factory or original sub-base. The router could be suspended by that portion of the tool comprising the original base plate or the original sub-base plate. Alternatively, the original base and/or sub-base could be replaced by members that are not substantially different in size-or nature, and the router suspended by that portion of the tool.

Also, the lid or hinged cover is not necessarily needed. It can be used to help secure the tool in place and provide a larger continuous surface around the bit.

The receiver according to the invention holds or suspends the tool. It can deter lateral and downward movement. This allows the installation and seating of the tool in the table top from above into operating position, as well as removal of the tool from above the table top.

Note that in the embodiments described in detail herein, the receiver comprises structure to accomplish these functions. A specific exemplary embodiment has the receiver comprising an opening 40 having a portion 42 adapted to support and seat the tool, but also an additional portion 44 which extends outside of and laterally of opening portion 42 to allow manipulation of and/or access to the tool body and associated structure from above the table top, but does not allow the portion of the tool seating into the receiver to pass through.

Most or many tools like hand-held routers and others mentioned herein have a base plate or similar structure around the working end of the too, and that base plate or similar structure has smaller perimeter dimensions than other cross sectional locations of the tool. An example is that the handles of a hand-held router are wider than the router's base plate diameter. Opening 40 gives room for the larger parts of the tool to pass below opening 40 from above (or be manipulated accordingly), but then allow the smaller in cross-section size base plate (or sub-base plate, substitute base plate, or substitute sub-base plate, or similar structure) to install and seat into and be supported in opening portion 42. This allows a tool having dimensions bigger than opening portion 42 to be placed into and removed the top-side of the table top.

The rotational deterrence discussed above can take on many forms or configurations. Another example would be through the shape of the receiver and/or the portion of the tool seating into the receiver. For example, the portion of the tool (e.g. substitute base plate 30) could have a non-perfect circle shape (such as with slightly flattened opposite sides) and would fit into a complementary opening portion 42. This would deter rotation of the tool in the receiver.

Additionally, in a simple implementation of the invention, an opening could be made directly in a table top. The table and/or table top could comprise the frame. The opening in the table top could comprise the receiver. As stated, a lid is optional. In this simple implementation, the opening would have a portion similar to portion 42 of FIGS. 3–10, that would receive that portion of the tool which will be used to suspend it. Another portion, analogous to portion 44 of FIGS. 3–10, would allow access and manipulation of the tool into place in the opening portion similar to portion 42. However, this would possibly leave open areas in the table top once the tool was seated. Instead of a lid over or closely around the tool, pieces could be placed into any remaining open areas, like puzzle pieces, to create a reasonably flat and smooth surface. Alternatively, there could be slide-in or swing up or down, or hinged pieces to fill in any openings.

Other options and alternatives are of course possible.

What is claimed is:

1. An apparatus to support a hand held motorized tool in an inverted position for table use comprising:

(a) a frame having an upper portion;

(b) a receiver in the frame, the receiver adapted to receive and support a portion of a motorized tool having a working end in an inverted position with its working end extending above the upper portion of the frame, and retain it against lateral or downward movement yet allowing removal upwardly by comprising an opening having a first portion adapted to allow passage of a substantial portion of a tool but not allowing downward passage of a portion of the tool; a second portion that allows access from above to the tool; and a retaining structure around at least a part of the first portion of the opening retaining the tool from lateral movement;

(c) so that the weight of the tool assists in keeping the tool stationary during support in the frame, but the opening in the frame allowing a user to access and remove the tool from above the frame when the frame is installed.

2. The apparatus of claim 1 wherein the frame is built into a table having a table top, and the upper portion of the frame is at or near the table top such that a working end of a tool can extend above the table top.

3. The apparatus of claim 2 wherein the table top is moveable between a generally horizontal working position and a raised position, and includes an opening adapted to allow passage of a working end of a tool when in the working position, such that the table top in the working position would deter upward movement of a tool in the frame.

4. The apparatus of claim 1 wherein said portion of the motorized tool comprises one of an original base plate or sub-base plate of the tool or a substitute base or sub-base plate which is not substantially bigger than the original base plate or sub-base plate of the tool.

5. The apparatus of claim 1 further comprising a device adapted to resist rotation between said portion of the tool and the receiver when the tool is positioned in the receiver.

6. The apparatus of claim 1 wherein the frame is a separate member adapted to matingly fit within an opening in a tabletop.

7. The apparatus of claim 6 wherein the opening in the tabletop is substantially larger in area than the largest portion of the tool.

8. The apparatus of claim 6 further comprising an annular ledge around the exterior of the frame to allow it to seat into an opening in a tabletop.

9. The apparatus of claim 1 further comprising a lid having an opening alignable with the first portion of the opening in the frame, and seatable in the frame above the opening in the frame, assisting in deterring upward movement of the tool.

10. The apparatus of claim 9 further comprising a removable insert ring mateable insertable into the opening in the lid to provide a bit passageway of smaller size than the opening in the lid.

11. The apparatus of claim 9 wherein the edges of the openings in the lid and the retaining ring are matingly beveled.

12. The apparatus of claim 1 wherein the tool is a router.

13. The apparatus of claim 12 wherein the router includes a base surrounding the working end or collet of the router.

14. The apparatus of claim 13 further comprising a subbase on the same order of size as but bigger than the base of the router, adapted to be fixedly mounted on the base of the router, the sub-base having an outer perimeter adapted to mateable seat into the receiver of the frame.

15. The apparatus of claim 14 wherein the sub-base is generally a ring not substantially bigger in outer perimeter dimensions than the base of the router.

16. A method of supporting a hand held motorized tool for inverted operation in a tabletop, yet allowing easy removal of the same, comprising:

supporting a portion of an inverted tool in a position so that the working end of the tool extends above the plane of the table top, and where the tool is removeably retained from lateral or downward movement, but is accessible and moveable upwardly from its supported position allowing access and removal of the tool from above the tabletop;

operating the tool in the supported inverted position in the table top.

17. The method of claim 16 wherein the tool is supported in a frame that is a part of a table.

18. The method of claim 16 wherein the tool is supported in a frame that is removable but seatable in a table top.

19. The method of claim 16 wherein the tool is supported by a ledge and one or more raised members.

20. The method of claim 16 further comprising inserting a lid or cover over the tool when supported in an inverted position, to deter upward movement of the tool.

21. The method of claim 16 further comprising varying the size of the opening through which the working end of the tool is exposed.

22. The method of claim 16 wherein the tool is a router.

23. An apparatus to support a handheld motorized tool in an inverted position for table top use comprising:

a frame comprising a top, bottom, opposite sides and opposite ends;

an opening in the frame between top and bottom, the opening having a first portion adapted to receive from above and mateable seat the tool against downward or lateral movement;

the opening having a second portion extending laterally from the first portion, sized to allow access to the tool when seated, and pivoting movement into or at least partially through the second portion of the opening, to assist in removal of the tool from the frame;

a cover member having an opening alignable with and mateably seatable into the frame over the first portion of the opening in the frame, adapted to cover and deter upward movement of the tool when seated in the frame.

24. The apparatus of claim 23 further comprising an outer edge of the frame adapted to be matingly seated into a tabletop.

25. The apparatus of claim 23 wherein the frame is built into a tabletop.

26. The apparatus of claim 23 wherein the tool is a router.

27. The apparatus of claim 26 further comprising an additional member fixably mountable onto the base of a tool, such they tool is substantially unrestricted to operate in a hand held mode, but the additional member seats in the receiver of the frame.

28. The apparatus of claim 23 further comprising a fence mounted on and removable with the cover member.

29. An apparatus to support a hand held motorized tool in an inverted position for table use comprising:

(d) a frame having an upper portion, the frame comprising an insert mateable with the opening of the tabletop and supported on a ledge extending into the opening of the tabletop, but including a smaller opening than the opening in the tabletop;

(e) a receiver in the frame, the receiver adapted to receive and support a portion of a motorized tool having a working end in an inverted position with its working end extending above the upper portion of the frame, and retain it against lateral or downward movement yet allowing removal upwardly, the receiver comprising an opening in the frame adapted to matingly seat a portion of the tool including a laterally extended portion adapted to allow access to the tool below the frame;

(f) so that the weight of the tool assists in keeping the tool stationary during support in the frame.

30. The apparatus of claim 29 further comprising an annular ledge surrounding the opening having a diameter less than the portion of a tool that will seat within it.

31. The apparatus of claim 30 further comprising at least one raised portion spaced back from the opening to retain a tool from lateral movement when seated in the receiver.

32. The apparatus of claim 31 wherein the raised portion comprises a perimeter wall sized to be just larger than the perimeter of a tool to be seated in the receiver.

33. An apparatus to support a hand held motorized tool in an inverted position for table use comprising:

(a) a frame having an upper portion and comprising a separate member adapted to matingly fit within an opening in a tabletop;

(b) a receiver in the frame, the receiver adapted to receive and support a portion of a motorized tool having a working end in an inverted position with its working end extending above the upper portion of the frame, and retain it against lateral or downward movement yet allowing removal upwardly;

(c) so that the weight of the tool assists in keeping the tool stationary during support in the frame;

(d) wherein the frame comprises an opening having a first portion adapted to allow passage of a substantial portion of a tool but not allowing downward passage of a portion of the tool; a second portion that allows access from above to the tool; and a retaining structure around at least a part of the first portion of the opening retaining the tool from lateral movement, and further comprising a lid having an opening alignable with the first portion of the opening in the frame, and seatable in the frame above the opening in the frame, assisting in deterring upward movement of the tool.

34. The apparatus of claim 33 further comprising a removable insert ring mateable insertable into the opening in the lid to provide a bit passageway of smaller size than the opening in the lid.

35. The apparatus of claim 33 wherein the edges of the openings in the lid and the retaining ring are matingly beveled.

36. A method of supporting a hand held motorized tool for inverted operation in a tabletop, yet allowing easy removal of the same, comprising:

supporting a portion of an inverted tool in a position so that the working end of the tool extends above the plane of the table top, and where the tool is retained from lateral or downward movement, but is moveable upwardly;

inserting a lid or cover over the tool when supported in an inverted position, to deter upward movement of the tool;

operating the tool in the inverted position in the table top.

* * * * *